US012421720B2

(12) United States Patent
Hara

(10) Patent No.: US 12,421,720 B2
(45) Date of Patent: Sep. 23, 2025

(54) SHED ROOFING STRUCTURE

(71) Applicant: SEKISUI HOUSE, LTD., Osaka (JP)

(72) Inventor: Takashi Hara, Osaka (JP)

(73) Assignee: SEKISUI HOUSE, LTD., Osaka (JP)

( * ) Notice: Subject to any disclaimer, the term of this patent is extended or adjusted under 35 U.S.C. 154(b) by 217 days.

(21) Appl. No.: 18/258,016

(22) PCT Filed: Jan. 20, 2022

(86) PCT No.: PCT/JP2022/002050
§ 371 (c)(1),
(2) Date: Jun. 16, 2023

(87) PCT Pub. No.: WO2022/168625
PCT Pub. Date: Aug. 11, 2022

(65) Prior Publication Data

US 2024/0102282 A1 Mar. 28, 2024

(30) Foreign Application Priority Data

Feb. 3, 2021 (JP) ..... 2021-015512

(51) Int. Cl.
*E04B 7/06* (2006.01)
*E04B 7/02* (2006.01)

(52) U.S. Cl.
CPC ..... *E04B 7/063* (2013.01); *E04B 7/02* (2013.01)

(58) Field of Classification Search
CPC ... E04B 7/06; E04B 7/02; E04B 7/022; E04B 7/024; E04B 7/028; E04B 7/04;
(Continued)

(56) References Cited

U.S. PATENT DOCUMENTS 1,657,243 A * 1/1928 Daniels ..... E04B 1/2604 248/300
3,421,270 A * 1/1969 Chaney ..... E04B 7/04 52/92.2

(Continued)

FOREIGN PATENT DOCUMENTS

EP 330587 A * 8/1989 ..... E04B 7/02
GB 2066868 A * 7/1981 ..... E04B 7/02

(Continued)

OTHER PUBLICATIONS

International Search Report issued in application No. PCT/JP2022/002050.

*Primary Examiner* — Kyle J. Walraed-Sullivan
(74) *Attorney, Agent, or Firm* — McClure, Qualey & Rodack, LLP

(57) ABSTRACT

A shed roofing structure includes: a corner rafter in which a top surface and a bottom surface form a mountain profile having a width-direction center as the vertex, the corner rafter exhibiting a fletched profile as seen in cross-section; a valley rafter formed by vertically inverting the corner rafter; a plurality of common rafters which are disposed horizontally spaced apart at a flat section of the inclined roof and inclined along a roof gradient; and a receiving plate member that is placed on respective top surfaces of an elongate transverse rafter which intersects the plurality of common rafters and supports at least the plurality of common rafters and the valley rafter from below, and a vertical member which supports the corner rafter from below, and that receives the corner rafter, the valley rafter, and the common rafters.

8 Claims, 12 Drawing Sheets

(58) Field of Classification Search
CPC . E04B 7/063; E04B 7/08; E04B 7/102; E04B 7/105; E06B 207/066
USPC ..... 52/90.1
See application file for complete search history.

(56) References Cited

U.S. PATENT DOCUMENTS 3,596,941 A * 8/1971 Tracy ..... E04B 7/02 52/713
4,080,771 A * 3/1978 Weller ..... E04B 7/04 52/92.2
4,229,915 A * 10/1980 Snow ..... E04B 7/063 403/219
4,275,534 A * 6/1981 Porter ..... E04B 1/24 52/653.1
4,409,763 A * 10/1983 Rydeen ..... E04B 1/26 52/93.2
4,546,579 A * 10/1985 Rionda ..... E04B 7/04 52/712
4,648,217 A * 3/1987 Watson ..... E04B 7/02 D25/17
4,686,802 A * 8/1987 O'Driscoll ..... E04B 7/06 52/92.3
4,873,797 A * 10/1989 Rydeen ..... E04B 1/10 52/92.3
4,878,323 A * 11/1989 Nelson ..... E04B 7/04 52/690
5,236,273 A * 8/1993 Gilb ..... E04B 1/2608 403/219
5,600,924 A * 2/1997 Forsberg ..... E04B 7/06 52/93.2
5,867,949 A * 2/1999 Untiedt ..... E04D 3/366 52/93.2
6,119,417 A * 9/2000 Valverde ..... E04B 7/20 52/223.7
6,223,481 B1 * 5/2001 Rickman ..... E04D 3/08 52/93.2
6,244,010 B1 * 6/2001 Sluiter ..... E04C 3/02 52/696
6,672,014 B1 * 1/2004 Jones ..... E04B 7/045 52/300
2002/0046511 A1 * 4/2002 Loyd ..... E04B 7/028 52/90.1
2003/0066250 A1 * 4/2003 Moore ..... E04B 7/04 52/283
2003/0233805 A1 * 12/2003 Horne ..... E04C 3/17 52/712
2004/0083676 A1 * 5/2004 Cameron ..... E04C 3/11 52/639
2004/0154257 A1 * 8/2004 Kawai ..... E04B 7/045 52/633
2012/0159896 A1 * 6/2012 Lin ..... E04D 12/004 52/848
2013/0055656 A1 * 3/2013 Grabow ..... E04C 3/12 52/745.2
2018/0224132 A1 * 8/2018 Gonzalez ..... F24S 10/753
2021/0355672 A1 * 11/2021 Bryant ..... E04C 2/521
2021/0381233 A1 * 12/2021 Sato ..... E04B 7/022

FOREIGN PATENT DOCUMENTS

GB 2424006 A * 9/2006 ..... E04B 7/06
JP 1999-1988 A 1/1999
JP 2004-225301 A 8/2004
JP 2008-13923 A 1/2008
JP 2018-184734 A 11/2018
JP 2020-176490 A 10/2020
WO WO-8203238 A * 9/1982 ..... E04B 1/26

* cited by examiner

[Fig. 1]
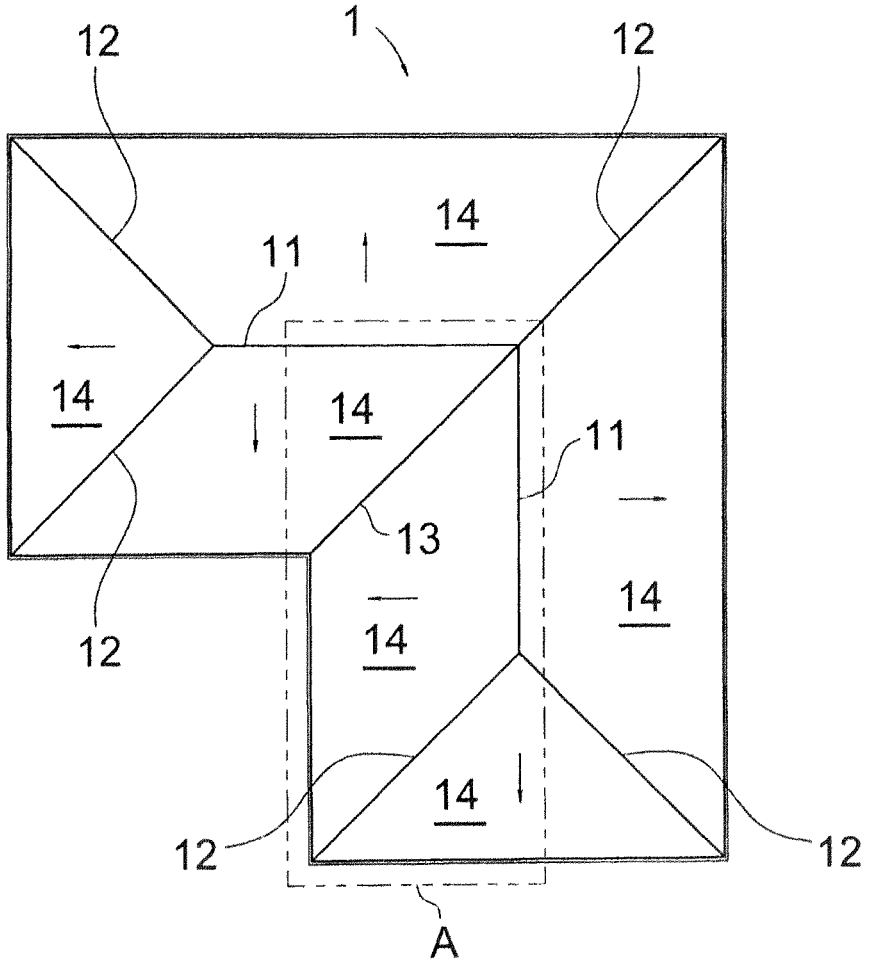

[Fig. 2]
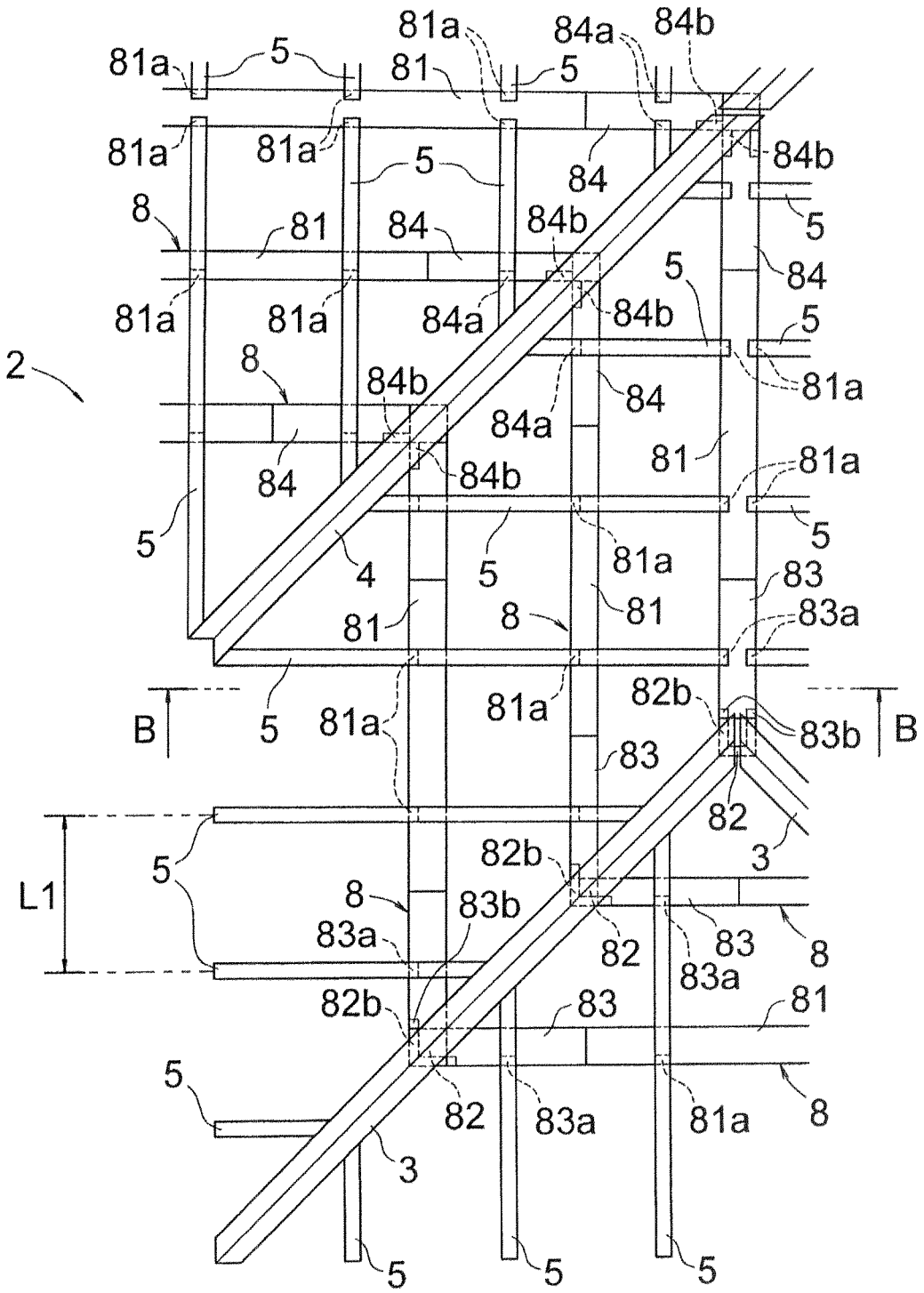

[Fig. 3]
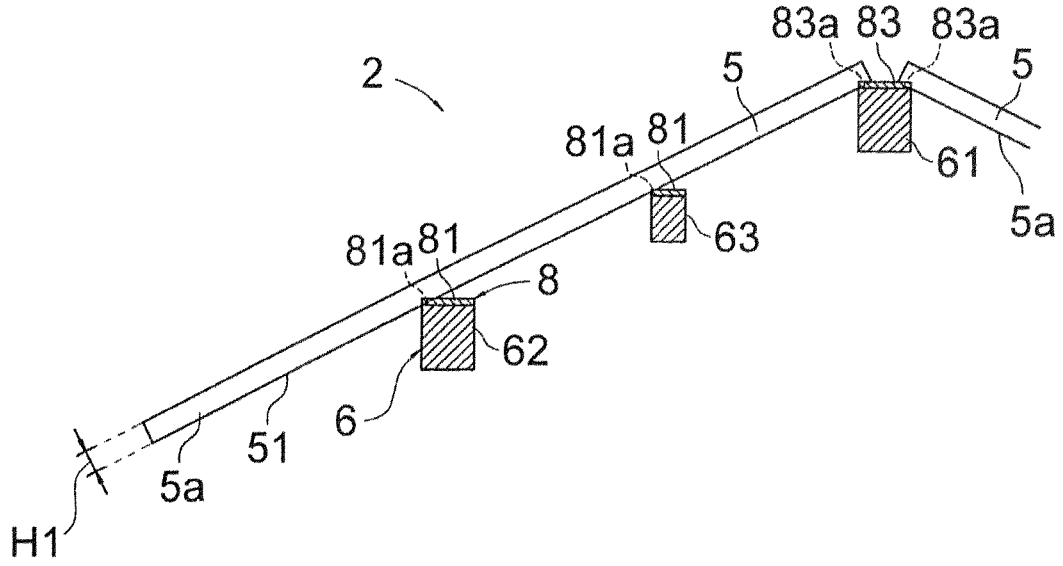

[Fig. 4]
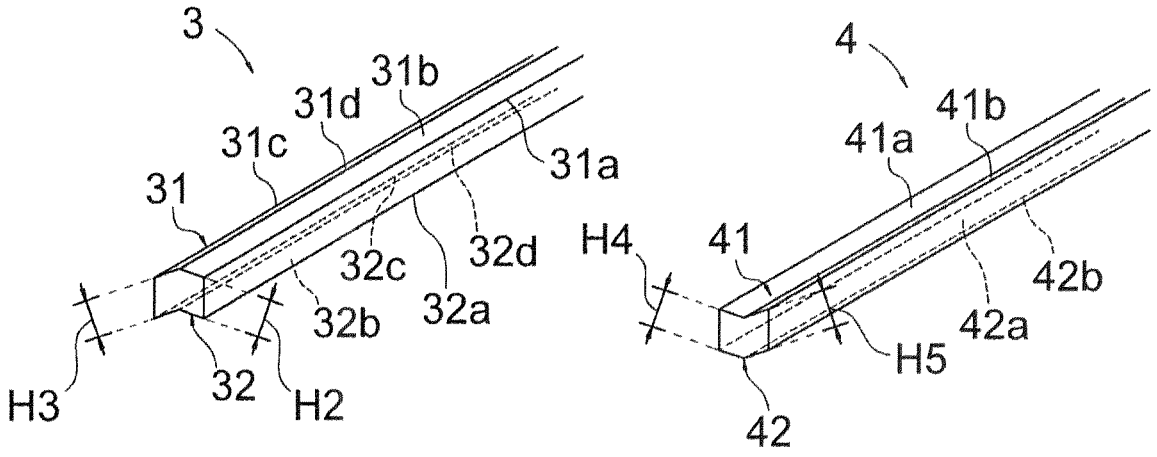

[Fig. 5]
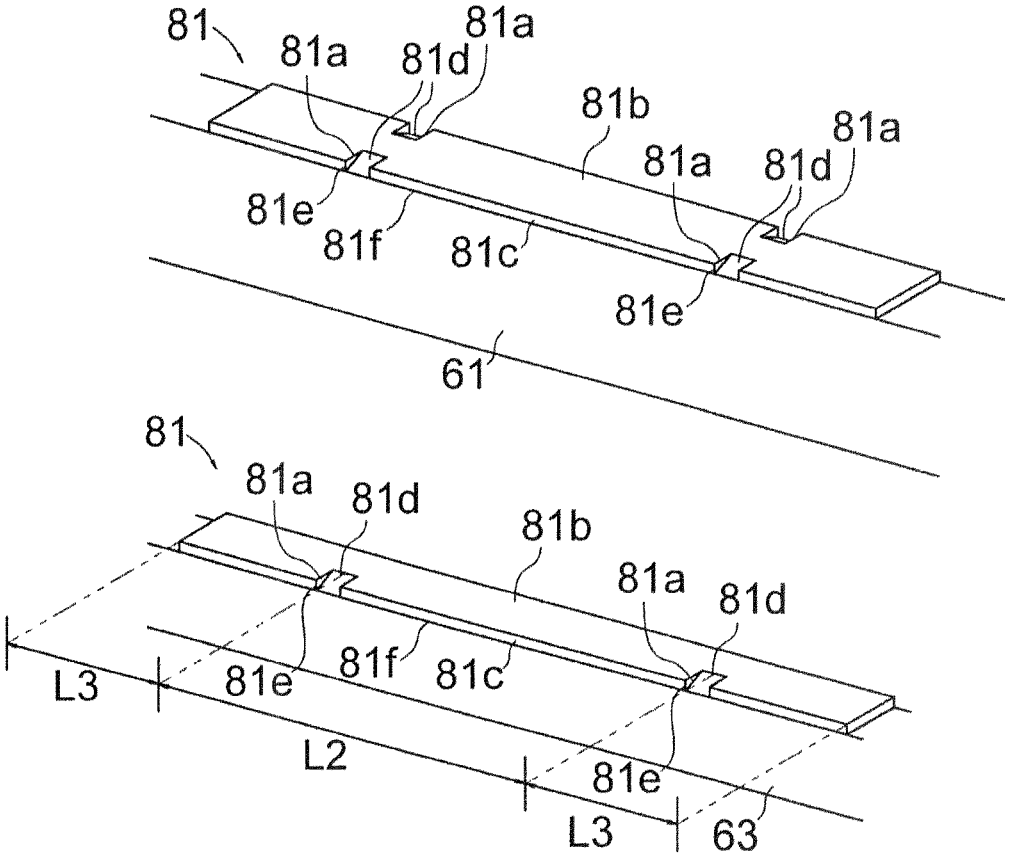

[Fig. 6]
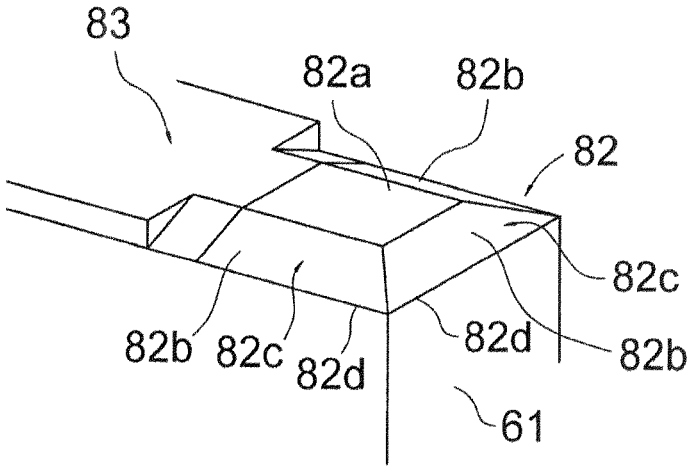
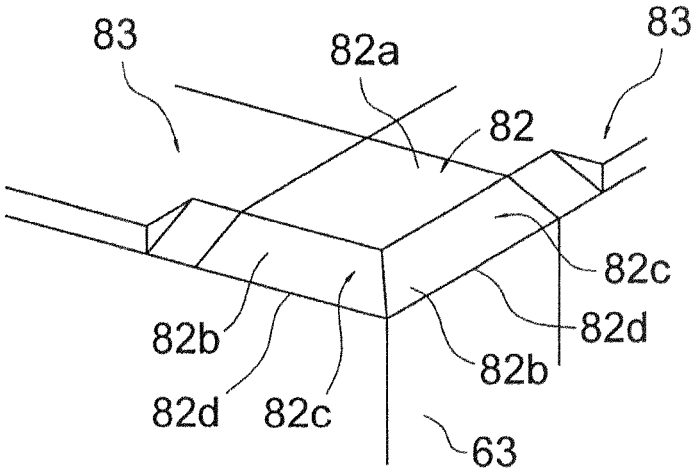

[Fig. 7]
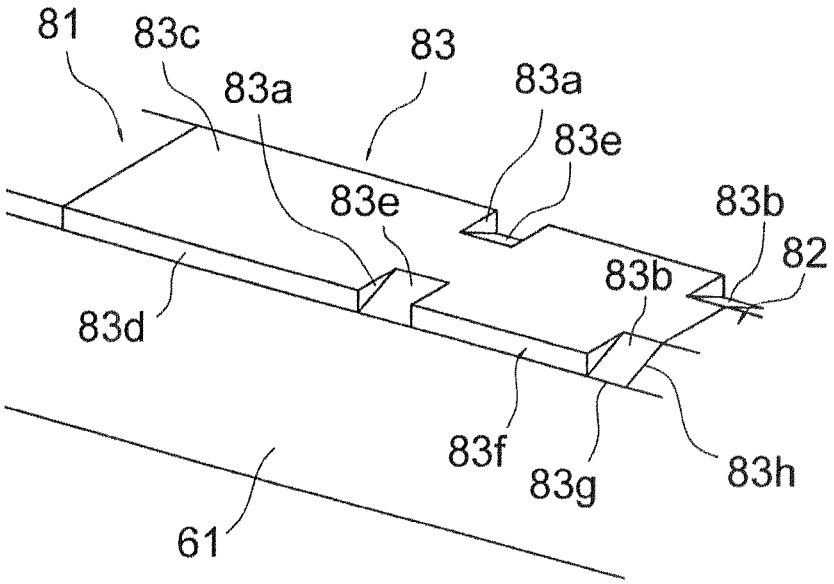
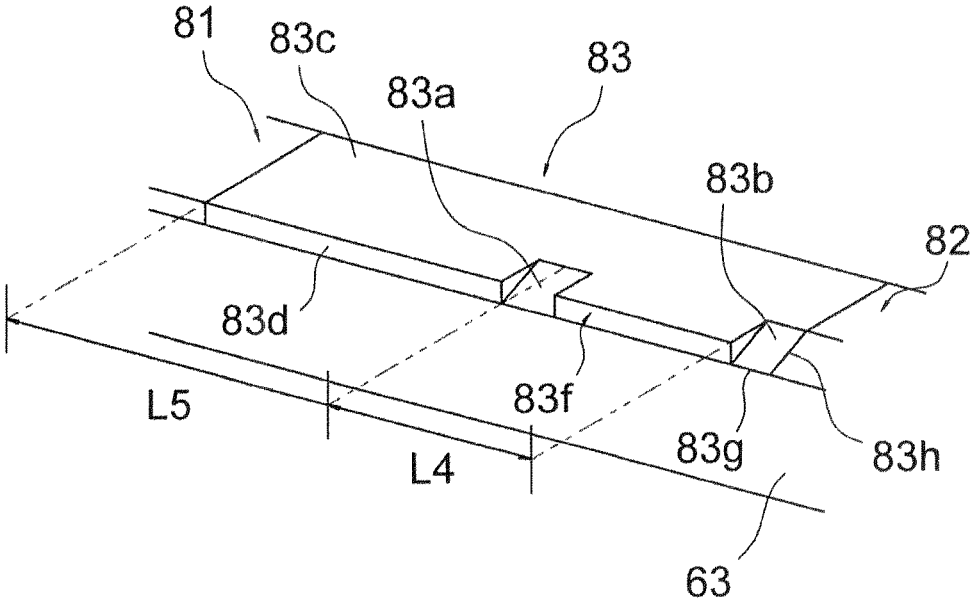

[Fig. 8]
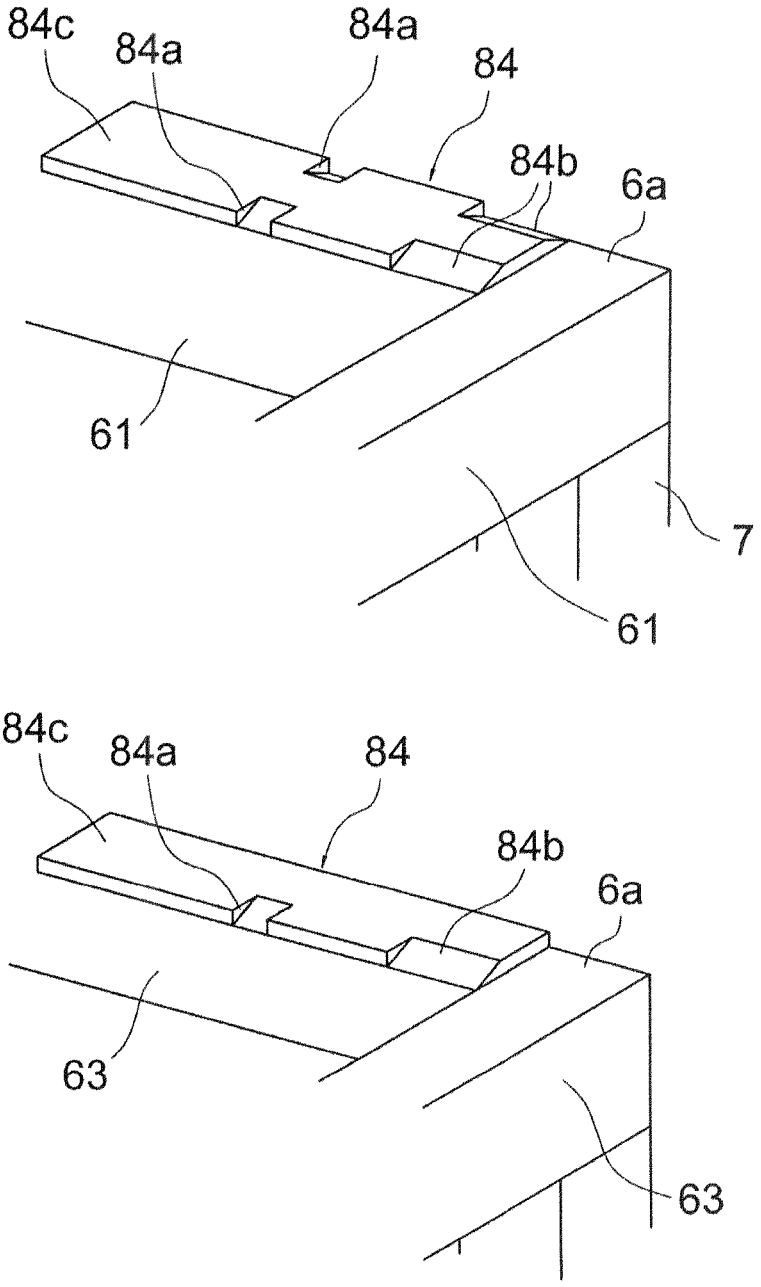

[Fig. 9]
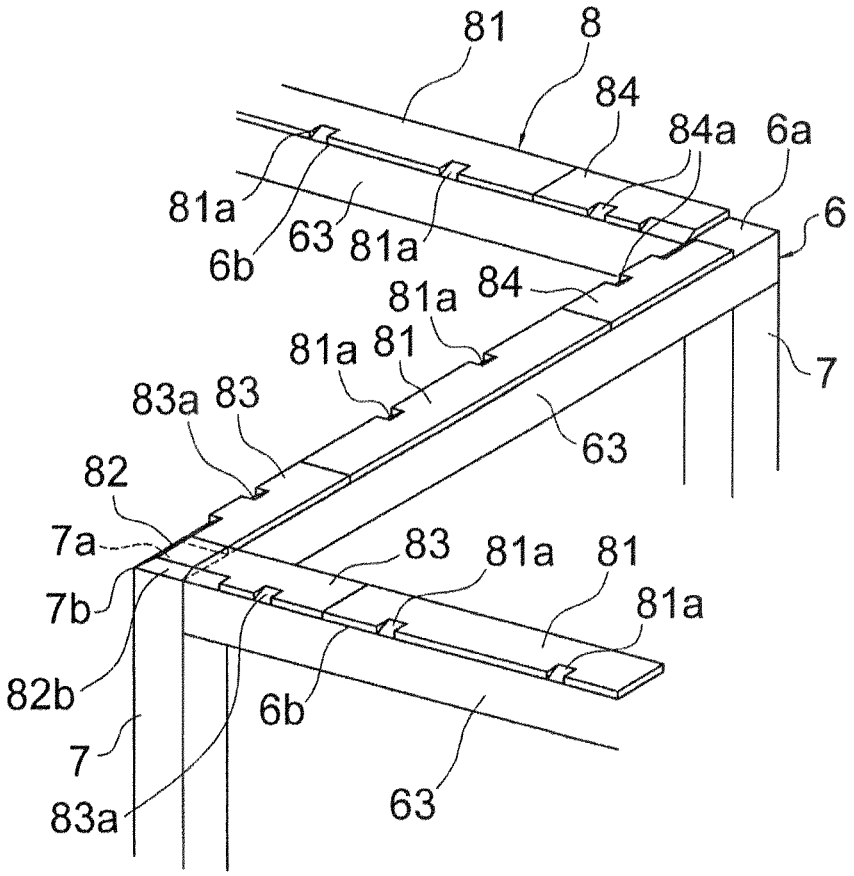

[Fig. 10]
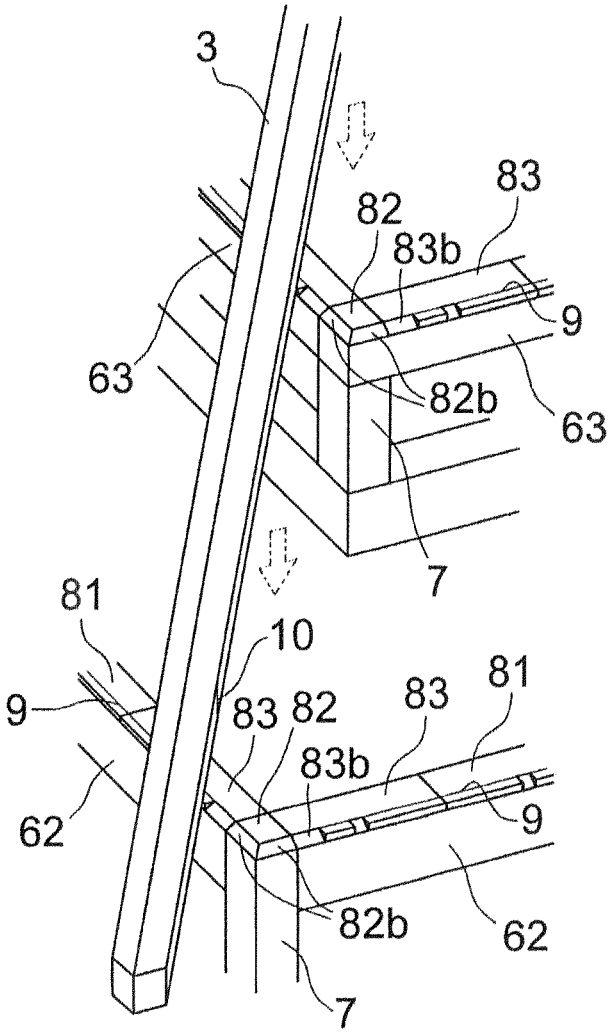

[Fig. 11]
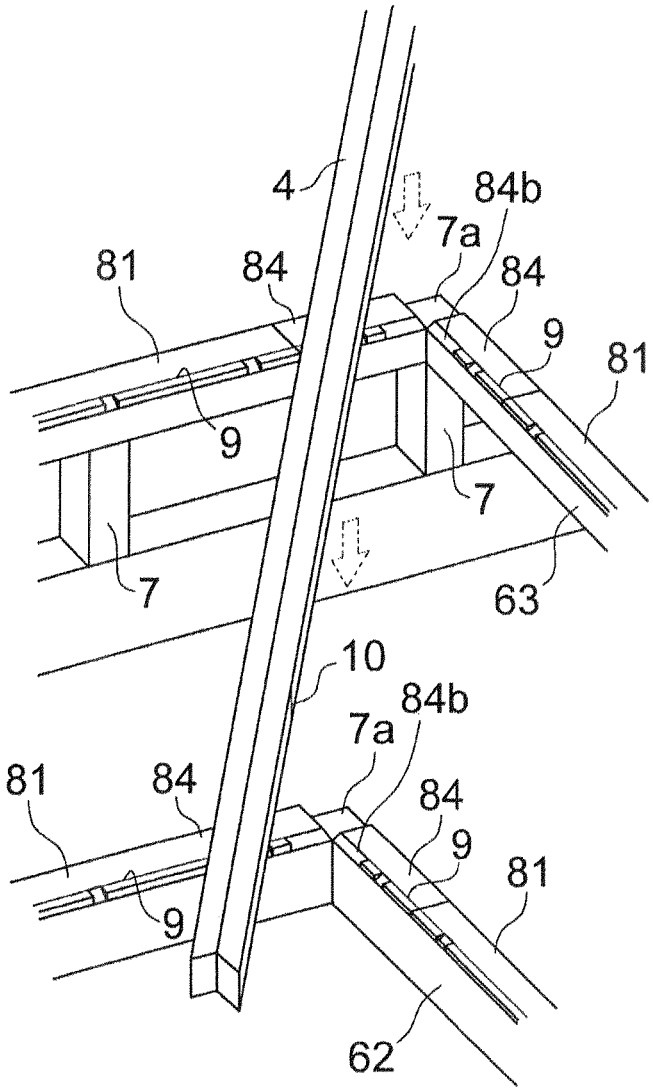

[Fig. 12]
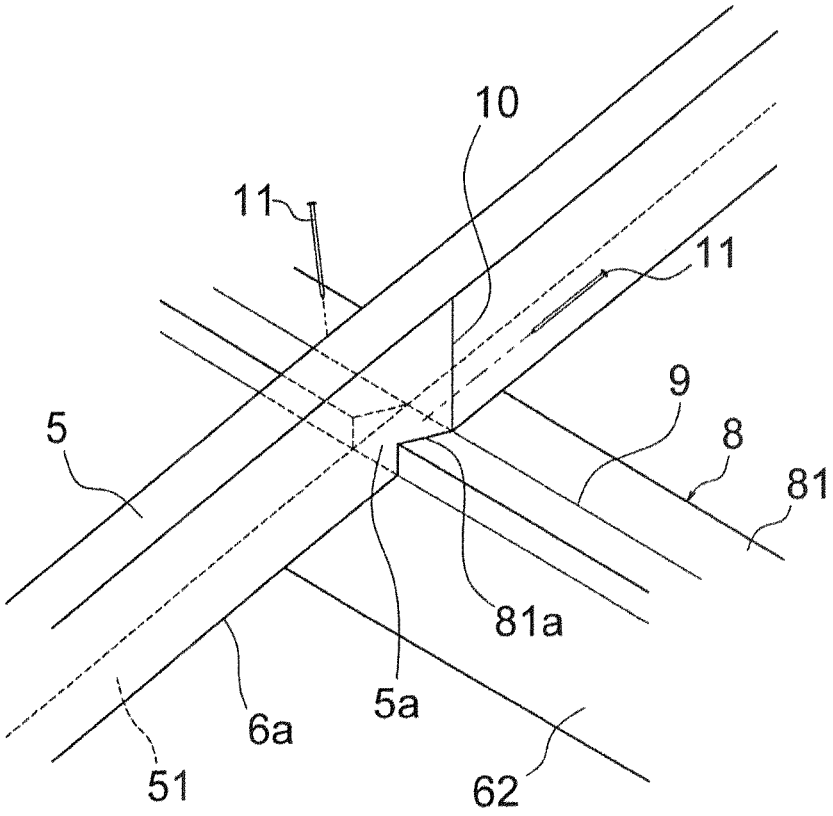

SHED ROOFING STRUCTURE

TECHNICAL FIELD

The present invention relates to a shed roofing structure of an inclined roof having a corner section and a valley section

BACKGROUND ART

Conventionally, it has been known that a common rafter which serves as the base of a sheathing roof board is directly installed on transverse rafters such as an eaves girder or purlin. Generally, a bottom end part of the common rafter inclined along a roof gradient, is fitted into a notch groove called a "rafter notch" formed at a downstream side corner of the transverse rafter, and accordingly the common rafter is not misaligned in the horizontal direction. In recent years, the rafter notch is formed by pre-cutting the transverse rafters with high-precision woodworking machines in advance, so that it is possible to keep the shape of the notch and the position in the horizontal direction uniform. However, if the type or specifications of the woodworking machine used are different for each factory, the reference point for the bottom end of the rafter notch will vary. Therefore, there is a possibility that the utmost height of a building may conflict with height limitation according to the Building Standards Act when the common rafters are installed at a construction site. Accordingly, a structure in which the rafter notch is not directly formed on the transverse rafter, and the rafter notch is formed on plate members installed on a top surface of the transverse rafter has been proposed (for example, Patent Literature 1).

The invention of Patent Literature 1 discloses a structure in which a plate-shaped rafter stand is installed on a top surface of transverse rafters such as an eaves girder or purlin, and a common rafter is fitted into a rafter notch which has a triangular profile as seen in cross-section and is formed on the rafter stand. The position of respective bottom ends of the rafter notches are aligned, so that the utmost height of a building can be made as designed when the common rafters are installed at a construction site.

CITATION LIST

Patent Literatures

Patent Literature 1: JP2018-184634A

Technical Problems

By the way, in the case of shed roofing with a corner section and a valley section such as a hipped roof, it is required to install oblique members such as a corner rafter and valley rafter on transverse rafters or vertical members such as a column member or shed struts member, other than common rafters. Generally, in the corner rafter and the valley rafter, only the top end part thereof is processed into mountain or valley shape along a roof gradient, and the bottom end part having the planar bottom surface is fitted into a notch groove formed on the top surface of transverse rafters or the top surface of vertical members. Usually, these oblique members are wider than common rafters, so that the notch groove should be formed by slicing a large portion of top surface of the transverse rafters and vertical members. Accordingly, there is a risk of reduction of the structure strength of the transverse rafters and vertical members due to sectional breaking. In such a case, it is possible to maintain the structure strength of the transverse rafters and vertical members if a notch groove for receiving the corner rafter and valley rafter on the rafter stand described in Patent Literature 1 are provided. However, since the extending direction of the corner rafter and valley rafter is different from that of the common rafters, the shape of the notch groove is likely to become complicated, and the processing becomes time consuming.

The present invention was made in view of the above circumstances. The present invention has an object to provide a shed roofing structure in which oblique members placed in individual locations of an inclined roof having corner sections and valley sections have an aligned reference height, with which the effort required for producing corner rafters and valley rafters is lessened, and in which the oblique members and transverse rafters or vertical members are easily joined.

Solutions to Problems

A shed roofing structure of a first aspect of the present invention includes a shed roofing structure of an inclined roof having a corner section and a valley section, including: a corner rafter disposed at the corner section; a valley rafter disposed at the valley section; a plurality of common rafters which are disposed horizontally spaced apart at a flat section of the inclined roof and inclined along a roof gradient; and a receiving plate member that is placed on respective top surfaces of an elongate transverse rafter which intersects the plurality of common rafters and supports at least the plurality of common rafters and the valley rafter from below, and a vertical member which supports the corner rafter from below, wherein an inclined surface for receiving respective bottom surfaces of the corner rafter and the valley rafter, and a notch groove for fitting respective bottom end parts of the plurality of common rafters are formed on a top surface of the receiving plate member.

In the shed roofing structure of a second aspect of the present invention, a top surface and a bottom surface of the corner rafter form a mountain profile having a width-direction center as the vertex, the corner rafter exhibiting a fletched profile as seen in cross-section.

In the shed roofing structure of a third aspect of the present invention, a top surface and a bottom surface of the valley rafter form a mountain profile having a width-direction center as the vertex, the valley rafter exhibiting a fletched profile as seen in cross-section.

In the shed roofing structure of a fourth aspect of the present invention, the valley rafter is formed by vertically inverting the corner rafter.

In the shed roofing structure of a fifth aspect of the present invention, the position of a downstream side edge of the receiving plate member coincides with respective downstream side edges of the transverse rafter and the vertical member, and bottom surfaces of the inclined surface and the notch groove incline upward along the roof gradient from the downstream side edge and a bottom end of the receiving plate member.

Advantageous Effects of the Invention

According to the shed roofing structure of a first aspect of the present invention, inclined surfaces for receiving respective bottom surfaces of corner rafters and valley rafters, and notch grooves for fitting respective bottom end parts of a plurality of common rafters are formed on a receiving plate member, not on the transverse rafter or vertical members.

Therefore, strength reduction of the transverse rafter or vertical member due to sectional breaking can be effectively prevented.

According to the shed roofing structure of a second aspect of the present invention, a top surface and a bottom surface of the corner rafter form a mountain profile having the width-direction center as the vertex, and the conner rafter exhibits a fletched profile as seen in cross-section. Therefore, it is not necessary to provide a notch groove or a receiving surface requiring complicated processing on the receiving plate member for receiving the corner rafter, and only an inclined surface having a simple shape is required to be formed.

According to the shed roofing structure of a third aspect of the present invention, a top surface and a bottom surface of the valley rafter form a mountain profile having the width-direction center as the vertex, and the valley rafter exhibits a fletched profile as seen in cross-section. Therefore, it is not necessary to provide a notch groove or a receiving surface requiring complicated processing on the receiving plate member for receiving the valley rafter, and only an inclined surface having a simple shape is required to be formed.

According to the shed roofing structure of a fourth aspect of the present invention, the valley rafter is formed only by vertically inverting the corner rafter, so that it is not necessary to separately produce the corner rafter and the valley rafter as in conventional methods, and therefore an economically excellent structure can be provided.

According to the shed roofing structure of a fifth aspect of the present invention, the position of a downstream side edge of the receiving plate member coincides with respective downstream side edges of the transverse rafter and the vertical member, and bottom surfaces of the inclined surface and the notch groove incline upward along a roof gradient from the downstream side edge and bottom end of the receiving plate member. Therefore, the respective downstream edges of bottom surfaces of the inclined surface and notch groove coincide with the respective top surfaces and downstream side edges of the transverse rafters and vertical members, and thus height reference of the bottom ends of the respective oblique members which are placed on these surfaces can be made same. Accordingly, it becomes possible to prevent the utmost height of a building from being different depending on the part of the roof.

BRIEF DESCRIPTION OF THE DRAWINGS

FIG. 1 is a schematic roof plan of an inclined roof.

FIG. 2 is a shed roof plan of a part A as shown in FIG. 1.

FIG. 3 is a cross sectional view of B-B line of FIG. 2.

FIG. 4 is a perspective view illustrating a corner rafter and a valley rafter.

FIG. 5 is a perspective view illustrating a first plate member.

FIG. 6 is a perspective view illustrating a second plate member.

FIG. 7 is a perspective view illustrating a third plate member.

FIG. 8 is a perspective view illustrating a fourth plate member.

FIG. 9 is a perspective view illustrating the state in which receiving plate members are installed on transverse rafters and vertical members.

FIG. 10 is a perspective view illustrating the situation in which the corner rafter is installed on top of the receiving plate member.

FIG. 11 is a perspective view illustrating the situation in which the valley rafter is installed on top of the receiving plate member.

FIG. 12 is a perspective view illustrating the situation in which a common rafter is installed on top of the receiving plate member.

DESCRIPTION OF EMBODIMENTS

Hereinafter, the most preferable embodiment of the shed roofing structure of the present invention will be described with reference to each drawing. The shed roofing structure of the present application is a structure mainly used in a hipped roof of wooden buildings, while it is also applicable to other types of inclined roofs having corner sections and valley sections. Note that "a top surface of the receiving plate member", "an edge at the downstream side of the receiving plate member", and "a bottom end of the receiving plate member" as used in the present invention correspond to "a top surface 81*b* of a first plate member, a top surface 82*a* of a second plate member, a top surface 83*c* of a third plate member, and a top surface 84*c* of a fourth plate member", "an edge 81*e* of the first plate member, an edge 82*c* of the second plate member, and an edge 83*f* of the third plate member", and "a bottom end 81*f* of the first plate member, a bottom end 82*d* of the second plate member, and a bottom end 83*g* of the third plate member" respectively, in the present embodiment. In addition, "the notch groove", and "a bottom surface of the notch groove" in the present invention refer to "a first notch groove 81*a*, a second notch groove 83*a*, and a third notch groove 84*a*" and "a bottom surface 81*d* of the first notch groove, and a bottom surface 83*e* of the second notch groove", respectively, in the present embodiment. Further, "the inclined surface" in the present invention refers to "a first inclined surface 82*b*, a second inclined surface 83*b*, and a third inclined surface 84*b*" in the present embodiment.

As shown in FIG. 1, an inclined roof 1 is a hipped roof having horizontally extending main ridge sections 11, corner sections 12 and valley sections 13 which obliquely extend toward downstream from the main ridge sections 11, and flat sections 14 on which roof tiles are installed. The shed roofing structure 2 of the inclined roof 1 formed as described above includes, as shown in FIGS. 1 to 3, corner rafters 3 disposed at the corner sections 12, a valley rafter 4 disposed at the valley section 13, a plurality of common rafters 5 installed horizontally spaced apart at the flat sections 14 and inclined downward along a roof gradient, and receiving plate members 8 that are placed on elongate transverse rafters 6 which intersect the common rafters 5 and support at least the common rafters 5 and the valley rafters 4 from below, and vertical members 7 (see FIG. 9) which support the corner rafters 3 from below.

The corner rafter 3 shown in FIGS. 2 and 4 is an elongate member extending along the slope of the corner section 12 mentioned above, and one end part at the downstream side protrudes in the shape of a mountain as seen in planar view, and another end part at the upstream side is cut off at an acute angle. Moreover, a top surface 31 and a bottom surface 32 of the corner rafter 3 form a mountain profile having an approximate center in the width-direction as the vertex, and the corner rafter exhibits a fletched profile as seen in cross-section. The top surface 31 of the corner rafter 3 is formed of a first top surface 31*b* of the corner rafter inclined from the approximate center in the width-direction toward one edge 31*a* in the width-direction, and a second top surface 31*d* of the corner rafter inclined from the approximate center in the width-direction toward another edge 31*c* in the width-direction. The inclination angles of these two surfaces 31*b* and 31*d* are the same as the roof gradient of the respective flat sections 14 formed on both sides of the corner sections 12, respectively. Further, the bottom surface 32 of the corner rafter 3 is formed of a first bottom surface 32*b* of the corner rafter inclined from the approximate center in the width-direction toward one edge 32*a* in the width-direction, and a second bottom surface 32*d* of the corner rafter inclined from the approximate center in the width-direction toward another edge 32*c* in the width-direction. In the bottom surface 32, the first bottom surface 32*b* of the corner rafter is formed at the same inclination angle as the first top surface 31*b* of the corner rafters, and the second bottom surface 32*d* of the corner rafter is formed at the same inclination angle as the second top surface 31*d* of the corner rafter.

On the other hand, the valley rafter 4 is an elongate member extending along the slope of the valley section 13 mentioned above, and is formed by vertically inverting the corner rafter 3. That is, a first top surface 41*a* of the valley rafter and a second top surface 41*b* of the valley rafter forming the top surface 41 of the valley rafter 4 are inclined at the same angle as the first bottom surface 32*b* of the corner rafter and the second bottom surface 32*d* of the corner rafter of the corner rafter 3, respectively, and also inclined at the same angle as a first bottom surface 42*a* of the valley rafter and a second bottom surface 42*b* of the valley rafter forming a bottom surface 42, respectively.

The common rafters 5 shown in FIGS. 2 and 3 are elongate square members inclined downward along the roof gradient from a ridge pole 61 or the corner rafter 3 to the flat section 14. A distance between centers L1 of adjacent common rafters 5 is about 500 mm, and one end part at the downstream side of the common rafter 5 further protrudes to the downstream from the eaves girder 62, or is joined in abutment with the valley rafter 4.

Since a sheathing roof board (not shown) which serves as a base material of the roof is placed on the upper parts of the corner rafter 3, the valley rafter 4, and the common rafter 5 formed as described above, the upper surfaces of joining parts of the respective oblique members 3, 4, and 5 should be set on the same plane. That is, a height H1 of the common rafter 5 shown in FIG. 3 is the same as a vertical distance H2 from the first top surface 31*b* of the corner rafter to the first bottom surface 32*b* of the corner rafter, and a vertical distance H3 from the second top surface 31*d* of the corner rafter to the second bottom surface 32*d* of the corner rafter of the corner rafter 3, and a vertical distance H4 from the first top surface 41*a* of the valley rafter to the first bottom surface 42*a* of the valley rafter, and a vertical distance H5 from the second top surface 41*b* of the valley rafter to the second bottom surface 42*b* of the valley rafter of the valley rafter 4, as shown in FIG. 4.

The transverse rafter 6 shown in FIG. 3 is an elongate square member which supports the corner rafters 3, the valley rafter 4, and the common rafter 5 from below, and has a ridge pole 61 installed at the main ridge section 11 mentioned below, an eaves girder 62 disposed at the most downstream side, and a purlin 63 installed between the ridge pole 61 and the eaves girder 62. The cross-section size of the respective transverse rafters 6 is not particularly limited since it is determined by structural calculation while taking the building shape or the location to be installed into consideration, and may be, for example, about 105 mm to 120 mm in width, and about 120 mm to 150 mm in height. Additionally, the vertical member 7 shown in FIG. 9 is a column member or shed struts members installed at a part where the transverse rafters 6 intersect, and as is shown, one end of the transverse rafter 6 is arranged to be aligned with the end of the vertical member 7, or one end of the transverse rafter 6 is placed on and aligned with the vertical member 7, depending on the installation location.

A receiving plate member 8 in plate shape as shown in FIGS. 2 and 9 is placed on the transverse rafter 6 and the vertical member 7. The receiving plate member 8 is a plate member formed by cutting a general plywood having a thickness of about 9 to 15 mm, a width of 1000 mm, and a length of about 2000 mm, and formed into four types of shapes depending on the installation location. As shown, the receiving plate member 8 includes a first plate member 81 installed on a linear portion of the transverse rafter 6, a second plate member 82 installed on a connection part with the corner rafter 3, a third plate member 83 installed between the first plate member 81 and the second plate member 82, and a fourth plate member 84 installed on a connection part with the valley rafter 4. Note that the length of each receiving plate members 8 is different depending on the installation location, while the width is the same as those of the transverse rafter 6 and the vertical member 7 on which the receiving plate member 8 is placed.

The first plate member 81 shown in FIGS. 2, 3, and 5 is an elongate plate member for receiving the common rafter 5 installed on the transverse rafter 6, and a first notch groove 81*a* is formed at an end part in the width-direction on which the common rafter 5 is installed. Note that as shown, since the ridge pole 61 receives the common rafters 5 at both sides in the width-direction, the first notch groove 81*a* is formed at both end parts in the width-direction on the first plate member 81 installed on the ridge pole 61. Further, the first plate member 81 installed on the eaves girder 62 and the purlin 63 receives the common rafter 5 only in one direction so that the first notch groove 81*a* is formed at only one end part in the width-direction. The first notch groove 81*a* is formed by slantly shaving a corner part formed by a top surface 81*b* and a side 81*c* in the width-direction of the first plate member 81 by the width of the common rafter 5, and is in a groove shape for fitting a bottom end part 5*a* of the common rafter 5. Further, a bottom surface 81*d* of the first notch groove 81*a* is inclined upward from an edge 81*e* of the first plate member 81 in the width-direction and a bottom end 81*f* of the first plate member 81, and the inclination angle thereof is the same as that of the roof gradient of the flat section 14 mentioned above. Therefore, by fitting the bottom end part 5*a* of the common rafter 5 into the first notch groove 81*a*, a bottom surface 51 of the common rafter 5 can be abutted against the bottom surface 81*d* of the first notch groove 81*a*.

The first plate member 81 is adjusted to have a length in a range of about 490 mm to 2000 mm according to a shape of the installation location. In the case where a plurality of the common rafters 5 are received, a plurality of first notch grooves 81*a* that coincide with the respective common rafters 5 are formed. In this case, a distance between centers L2 of the first notch grooves 81*a* shown in FIG. 5 is the same as the distance between centers L1 of the common rafters 5 mentioned above, and a distance L3 from both ends of the first plate member 81 in the length direction to a center of the proximate first notch groove 81*a* is about 245 mm to 250 mm.

The second plate member 82 shown in FIGS. 2 and 6 is a plate member having an approximately square shape as seen in planar view for receiving the corner rafter 3, and a first inclined surface 82*b* for receiving the corner rafter 3 is formed at a downstream-side end part of the top surface 82*a*.

Note that as shown, in the second plate member 82 installed on the ridge pole 61, three directional edges are inclined toward downstream side among edges in the horizontal direction, and therefore the first inclined surface 82*b* having a C-shape as seen in planar view is formed. On the other hand, in the second plate member 82 installed on the eaves girder 62 or the purlin 63, two directional edges are inclined toward downstream side among edges in the horizontal direction, and therefore the first inclined surface 82*b* having an L-shape as seen in planar view is formed. This first inclined surface 82*b* is inclined upward from the edge 82*c* positioned at the downstream side when the second plate member 82 is placed on the transverse rafter 6 or the vertical member 7, among edges in the horizontal direction of the second plate member 82, and the bottom end 82*d* of the second plate member 82, and its inclination angle is the same as that of the roof gradient of the respective flat sections 14 extending to both sides of the corner sections 12. Accordingly, the bottom surface 32 of the corner rafter 3 can be abutted against the first inclined surface 82*b* when the corner rafter 3 is placed on the first inclined surface 82*b*.

The third plate member 83 shown in FIGS. 2 and 7 is a relatively elongate plate member for receiving the common rafter 5 and the corner rafter 3 at the same time. In the third plate member 83, the second notch groove 83*a* is formed at an end part in the width-direction on which the common rafter 5 is installed, and the second inclined surface 83*b* is formed at the part where the corner rafter 3 is installed. As shown, in the third plate member 83 installed on the ridge pole 61, the second notch groove 83*a* and the second inclined surface 83*b* are respectively formed at both end parts in the width-direction. In the third plate member 83 installed on the eaves girder 62 and purlin 63, the second notch groove 83*a* and the second inclined surface 83*b* are formed at only one end part in the width-direction. The second notch groove 83*a* is formed by slantly shaving a corner part formed by a top surface 83*c* and a side 83*d* in the width-direction of the third plate member 83 by the width of the common rafter 5. The width of the notch, inclination angle of the bottom surface 83*e*, and the edge position at the downward side are the same as the configurations of the first notch groove 81*a*. On the other hand, the second inclined surface 83*b* is a surface inclined upward from the edge 83*f* positioned at the downstream side when the third plate member 83 is placed on the transverse rafter 6 or the vertical member 7, among the edges in the horizontal direction of the third plate member 83, and the bottom end 83*g* of the third plate member 83. The second inclined surface 83*b* is formed in a width of about 30 mm to 35 mm from an edge 83*h* at a side of the second plate member 82. Note that the inclination angle of the second inclined surface 83*b* is the same as that of the first inclined surface 82*b*.

The third plate member 83 is a plate member with the whole length of about 440 mm to 450 mm, and is formed such that a distance L4 from the center of the second notch groove 83*a* in the width-direction to the second inclined surface 83*b* is about 100 mm to 110 mm, and a distance L5 from the center of the second notch groove 83*a* in the width-direction to the edge opposite to the second inclined surface 83*b* is about 245 mm to 250 mm.

The fourth plate member 84 shown in FIGS. 2 and 8 is a plate member for receiving the common rafter 5 and the valley rafter 4 at the same time, and the third notch groove 84*a* is formed at a part on which the common rafter is installed as well as the third inclined surface 84*b* is formed at a part on which the valley rafter 4 is installed. As shown, in the fourth plate member 84 installed on the ridge pole 61, the third notch groove 84*a* and the third inclined surface 84*b* are respectively formed at both end parts in the width-direction. In the fourth plate member 84 installed on the eaves girder 62 and purlin 63, the third notch groove 84*a* and the third inclined surface 84*b* are formed at only one end part in the width-direction. Note that this fourth plate member 84 has the same configuration as that of the third plate member 83 except that the width of the third inclined surface 84*b* is about 90 mm to 95 mm, and therefore the detailed explanation is omitted.

In the receiving plate member 8 formed as described above, the height and depth dimension of the respective inclined surfaces 82*b*, 83*b*, and 84*b* are common with those of the respective notch grooves 81*a*, 83*a*, and 84*a*. In addition, the shapes of the respective inclined surfaces 82*b*, 83*b*, and 84*b* are simple as compared with a conventional notch groove for receiving the corner rafter and valley rafter. Note that since the receiving plate member 8 is a member for receiving the respective bottom ends of the corner rafter 3, the valley rafter 4, and the common rafter 5, on a part that does not receive any of the corner rafter 3, the valley rafter 4, or the common rafter 5, for example, an internal corner part formed at a joining part between intersecting transverse rafters 6, as shown in FIG. 9, the receiving plate member 8 is not installed.

Next, a construction method for the shed roofing structure 2 is described. The transverse rafters 6 shown in FIG. 3 are bridged over vertical members 7 such as a column member or shed struts member (not shown) in advance, and are disposed parallel to one another while forming height difference along the roof gradient. As is shown in FIG. 9, the respective receiving plate members 8 are placed on a predetermined position of the transverse rafters 6 and the vertical members 7, and nails (not shown) are hammered from above in a staggered manner to fix the respective receiving plate members 8 to the transverse rafters 6 and the vertical members 7. Note that the first plate member 81, the third plate member 83, and the fourth plate member 84 installed on the eaves girder 62 and the purlin 63 are installed such that the respective notch grooves 81*a*, 83*a*, and 84*a* are positioned at the downstream side. Further, the direction of the second plate member 82 is adjusted such that the first inclined surface 82*b* is toward the downstream side. Note that in this occasion, the width of the respective receiving plate members 8 is the same as that of the transverse rafter 6 and the vertical member 7 on which the receiving plate members 8 are placed, and therefore the downstream side edges and the bottom ends of the respective receiving plate members 8 are aligned with an edge 6*b* at the downstream side of the top surface 6*a* of the transverse rafter 6, or an edge 7*b* at the downstream side of the top surface 7*a* of the vertical member 7.

Subsequently, as shown in FIGS. 10 to 12, black ink 9 is drawn on each of the top surface 81*b* of the first plate member 81, the top surface 83*c* of the third plate member 83, and the top surface 84*c* of the fourth plate member 84, and black ink 10 serving as a reference of the projection of eaves is drawn on each side of the corner rafter 3, the valley rafter 4, and the common rafter 5. The black ink 9 is a line that marks along the longitudinal direction of the transverse rafter 6 and indicates the position of upstream side edges of the notch grooves 81*a*, 83*a*, and 84*a*, and the inclined surfaces 82*b*, 83*b*, and 84*b*. The black ink 9 serves as a reference of the installation position of the corner rafter 3, the valley rafter 4, and the common rafter 5. Then, the corner rafter 3 is made to abut on the first inclined surface 82*b* of the second plate member 82, and the second inclined surface

83*b* of the third plate member 83. At the same time, the black ink 10 of the corner rafter 3 is aligned with the black ink 9 drawn on the third plate member 83, and a nail (not shown) is hammered from above of the corner rafter 3 to fix the corner rafter 3 to the transverse rafter 6 or the vertical member 7. Furthermore, the valley rafter 4 is made to abut on the third inclined surface 84*b* of the fourth plate member 84, and the black ink 10 is aligned with the black ink 9 drawn on the fourth plate member 84 to fix the valley rafter 4 to the transverse rafter 6 by hammering a nail (not shown) from above.

Next, as shown in FIGS. 2 and 12, the common rafter 5 is fitted into the respective notch grooves 81*a*, 83*a*, and 84*a*, to make the bottom surface 51 of the common rafter 5 abut to the respective receiving plate members 8. Then, the black ink 10 of the common rafter 5 is aligned with the black ink 9 drawn on the first plate member 81, the third plate member 83, and the fourth plate member 84 to align the projection of eaves of the common rafter 5 from the eaves girder 62, a nail 11 is hammered from a side of the common rafter 5 to fix the common rafter 5 to the respective transverse rafters 6. Finally, nails (not shown) are hammered to an abutting part of the corner rafter 3 and the common rafter 5, and an abutting part of the valley rafter 4 and the common rafter 5 shown in FIG. 2, to fix the common rafter 5 to the corner rafter 3 and the valley rafter 4, and thereby the shed roofing structure 2 is completed.

In the shed roofing structure 2 of the present application formed as described above, the height reference of each bottom end of the corner rafter 3, the valley rafter 4, and a plurality of the common rafters 5 is aligned, and the top surfaces of joining parts of the corner rafter 3, the valley rafter 4, and the common rafter 5 are on the same plane each other, and therefore the utmost height of a building does not become different depending on the part of the roof. Accordingly, it is possible to prevent the utmost height of the building from conflicting with height limitation according to the Building Standards Act even if the type or specifications of the woodworking machine used are different for each factory. Furthermore, since the inclined surfaces 82*b*, 83*b*, and 84*b* for receiving the corner rafter 3 and the valley rafter 4, and the respective notch grooves 81*a*, 83*a*, and 84*a* for receiving a plurality of the common rafters 5 are formed on the receiving plate member 8, not on the transverse rafter 6 or the vertical member 7, strength reduction of the transverse rafter 6 or the vertical member 7 due to sectional breaking can be effectively prevented. In addition, the valley rafter 4 can be formed only by vertically inverting the corner rafter 3, so that it is not necessary to separately produce the corner rafter 3 and the valley rafter 4 as in conventional methods, and therefore an economically excellent structure can be provided. Moreover, the bottom surface 32 of the corner rafter 3 and the bottom surface 42 of the valley rafter 4 are in a mountain shape. Therefore, it is not necessary to provide a notch groove or a receiving surface requiring complicated processing on the respective receiving plate members 8 for receiving the corner rafter 3 and the valley rafter 4, and only an inclined surface having a simple shape is required to be formed.

DESCRIPTION OF REFERENCE SIGNS

1 inclined roof
12 corner section
13 valley section
14 flat section
2 shed roofing structure
3 corner rafter
31 top surface of the corner rafter
32 bottom surface of the corner rafter
4 valley rafter
5 common rafter
51 bottom surface of the common rafter
5*a* bottom end part of the common rafter
6 transverse rafter
6*a* top surface of the transverse rafter
6*b* edge at the downstream side of the transverse rafter
7 vertical member
7*a* top surface of the vertical member
7*b* edge at the downstream side of the vertical member
8 receiving plate member
81*a* first notch groove (notch groove)
81*b* top surface of a first plate member (top surface of the receiving plate member)
81*d* bottom surface of the first notch groove (bottom surface of the notch groove)
81*e* edge of the first plate member (edge at the downstream side of the receiving plate member)
81*f* bottom end of the first plate member (bottom end of the receiving plate member)
82*a* top surface of a second plate member (top surface of the receiving plate member)
82*b* first inclined surface (inclined surface)
82*c* edge of the second plate member (edge at the downstream side of the receiving plate member)
82*d* bottom end of the second plate member (bottom end of the receiving plate member)
83*a* second notch groove (notch groove)
83*b* second inclined surface (inclined surface)
83*c* top surface of a third plate member (top surface of the receiving plate member)
83*e* bottom surface of the second notch groove (bottom surface of the notch groove)
83*f* edge of the third plate member (edge at the downstream side of the receiving plate member)
83*g* bottom end of the third plate member (bottom end of the receiving plate member)
84*a* third notch groove (notch groove)
84*b* third inclined surface (inclined surface)
84*c* top surface of a fourth plate member (top surface of the receiving plate member)

The invention claimed is:

1. A shed roofing structure of an inclined roof having a corner section and a valley section, comprising:

a corner rafter disposed at the corner section;

a valley rafter disposed at the valley section;

a plurality of common rafters which are disposed horizontally spaced apart at a flat section of the inclined roof and inclined along a roof gradient; and a receiving plate member that is placed on respective top surfaces of an elongate transverse rafter which intersects the plurality of common rafters and supports at least the plurality of common rafters and the valley rafter from below, and a vertical member which supports the corner rafter from below, wherein the receiving plate member includes a first plate member installed on a linear portion of the transverse rafter, a second plate member installed on a connection part with the corner rafter of the vertical member or the transverse rafter, a third plate member installed between the first plate member and the second plate member, and a fourth plate member installed on a connection part with the valley rafter of the transverse rafter, the first plate member includes a plurality of first notch grooves for fitting respective bottom end parts of the plurality of common rafters formed on a top surface of the first plate member, the second plate member includes a first inclined surface for receiving a bottom surface of the corner rafter formed on a top surface of the second plate member, the third plate member includes a second notch groove for fitting a bottom end part of a common rafter and a second inclined surface for receiving the bottom surface of the corner rafter formed on a top surface of the third plate member, the fourth plate member includes a third notch groove for fitting the bottom end part of the common rafter and a third inclined surface for receiving a bottom surface of the valley rafter formed on a top surface of the fourth plate member, the bottom surface of the corner rafter forms a mountain profile having a width-direction center as a vertex and an upper side convex, the first inclined surface includes a plurality of first inclined surfaces inclined toward at least two directions, and the second inclined surface are on a same plane with the first inclined surface, and the bottom surface of the valley rafter forms a mountain profile having a width-direction center as a vertex and a lower side convex.

2. The shed roofing structure according to claim 1, wherein a top surface and the bottom surface of the corner rafter form a mountain profile having a width-direction center as the vertex, the corner rafter exhibiting a fletched profile as seen in cross-section.

3. The shed roofing structure according to claim 2, wherein a top surface and the bottom surface of the valley rafter form a mountain profile having a width-direction center as the vertex, the valley rafter exhibiting a fletched profile as seen in cross-section.

4. The shed roofing structure according to claim 3, wherein a position of a downstream side edge of the receiving plate member coincides with respective downstream side edges of the transverse rafter and the vertical member, and bottom surfaces of the plurality of first inclined surfaces, the second inclined surface, the third inclined surface, the first notch groove, the second notch groove, and the third notch groove incline upward along the roof gradient from the downstream side edge and a bottom end of the receiving plate member.

5. The shed roofing structure according to claim 2, wherein a position of a downstream side edge of the receiving plate member coincides with respective downstream side edges of the transverse rafter and the vertical member, and bottom surfaces of the plurality of first inclined surfaces, the second inclined surface, the third inclined surface, the first notch groove, the second notch groove, and the third notch groove incline upward along the roof gradient from the downstream side edge and a bottom end of the receiving plate member.

6. The shed roofing structure according to claim 1, wherein a top surface and the bottom surface of the valley rafter form a mountain profile having a width-direction center as the vertex, the valley rafter exhibiting a fletched profile as seen in cross-section.

7. The shed roofing structure according to claim 6, wherein a position of a downstream side edge of the receiving plate member coincides with respective downstream side edges of the transverse rafter and the vertical member, and bottom surfaces of the plurality of first inclined surfaces, the second inclined surface, the third inclined surface, the first notch groove, the second notch groove, and the third notch groove incline upward along the roof gradient from the downstream side edge and a bottom end of the receiving plate member.

8. The shed roofing structure according to claim 1, wherein a position of a downstream side edge of the receiving plate member coincides with respective downstream side edges of the transverse rafter and the vertical member, and bottom surfaces of the plurality of first inclined surfaces, the second inclined surface, the third inclined surface, the first notch groove, the second notch groove, and the third notch groove incline upward along the roof gradient from the downstream side edge and a bottom end of the receiving plate member.

* * * * *